US007497654B2

(12) United States Patent
Lavez et al.

(10) Patent No.: US 7,497,654 B2
(45) Date of Patent: Mar. 3, 2009

(54) VARIABLE NOZZLE DEVICE FOR A TURBOCHARGER AND METHOD FOR OPERATING THE SAME

(75) Inventors: Alexis Lavez, Thaon les Vosges (FR); Alain Lombard, Thaon les Vosges (FR); Emmanuel Severin, Thaon les Vosges (FR); Raphael Hettinger, Thaon les Vosges (FR)

(73) Assignee: Honeywell International Inc., Morristown, NJ (US)

( * ) Notice: Subject to any disclaimer, the term of this patent is extended or adjusted under 35 U.S.C. 154(b) by 226 days.

(21) Appl. No.: 10/528,643

(22) PCT Filed: Sep. 18, 2002

(86) PCT No.: PCT/IB02/03834

§ 371 (c)(1), (2), (4) Date: May 19, 2006

(87) PCT Pub. No.: WO2004/035994

PCT Pub. Date: Apr. 29, 2004

(65) Prior Publication Data

US 2006/0216141 A1 Sep. 28, 2006

(51) Int. Cl.
*F01D 17/14* (2006.01)
*F01D 17/16* (2006.01)

(52) U.S. Cl. ..... 415/1; 415/127; 415/157

(58) Field of Classification Search ..... 415/14, 415/126, 127, 128, 131, 132, 155, 157, 158, 415/160

See application file for complete search history.

(56) References Cited

U.S. PATENT DOCUMENTS

| | | | | |
|---|---|---|---|---|
| 2,341,974 | A * | 2/1944 | Browne | 415/26 |
| 2,976,013 | A | 3/1961 | Hunter | |
| 4,557,665 | A | 12/1985 | Szczupak | |
| 4,890,977 | A | 1/1990 | Treaine et al. | |
| 5,214,920 | A | 6/1993 | Leavesly | |
| 6,314,736 | B1 | 11/2001 | Daudel et al. | |

FOREIGN PATENT DOCUMENTS

| | | |
|---|---|---|
| EP | 034915 | 9/1981 |
| EP | 1128025 | 8/2001 |
| GB | 138592 | 5/1920 |
| WO | WO01/53679 | 7/2001 |
| WO | WO02/44527 | 6/2002 |
| WO | ISR/WO | 6/2003 |

* cited by examiner

*Primary Examiner*—Edward Look
*Assistant Examiner*—Nathaniel Wiehe

(57) ABSTRACT

A variable nozzle device (1) for a turbocharger comprises an annular nozzle (3) formed between an inner wall (11) and an outer wall (10), and an annular arrangement of adjustable vanes (4) interposed in the nozzle (3) for defining a plurality of nozzle passages, wherein the nozzle (3) is adjustable by controllably adjusting the vanes (4) and by controllably varying an axial clearance between the outer wall (10) and the vanes (4).

2 Claims, 5 Drawing Sheets

Fully closed

1/2 open

Fully open

VARIABLE NOZZLE DEVICE FOR A TURBOCHARGER AND METHOD FOR OPERATING THE SAME

The present invention generally relates to a variable nozzle device for a turbocharger, and also to a method for operating a variable nozzle device for a turbocharger.

A turbocharger having a conventional variable nozzle device is known from U.S. Pat. No. 4,643,640. The nozzle device comprises an annular nozzle between an inner wall and an outer wall, and an annular arrangement of adjustable vanes interposed in the nozzle for defining a plurality of nozzle passages, wherein the nozzle is adjustable by controllably pivoting the vanes between the inner and outer walls.

Thereby, the nozzle passages vary the gas flow to the turbine, i.e. the gas flow area of the annular nozzle. The annular nozzle is formed by a nozzle ring which forms the inner wall, a shroud which forms the outer wall, and the pivotable vanes. There has to be a clearance or a gap between the pivotable vanes and the shroud so as to hold the vanes pivotable. The size of such clearance is usually limited to both ensure performance level and prevent the vanes from sticking to the shroud.

It is the object of the present invention to provide a variable nozzle device for a turbocharger and a method for operating a variable nozzle device which allow an improved turbine performance.

This object is achieved by a variable nozzle device having the features of claim 1 or 10, and by a method of operating a variable nozzle device having the features of claim 7. The invention is further developed by the dependent claims.

A first embodiment of a nozzle device 1 according to the present invention is described with reference to FIG. 1.

Figure 1:
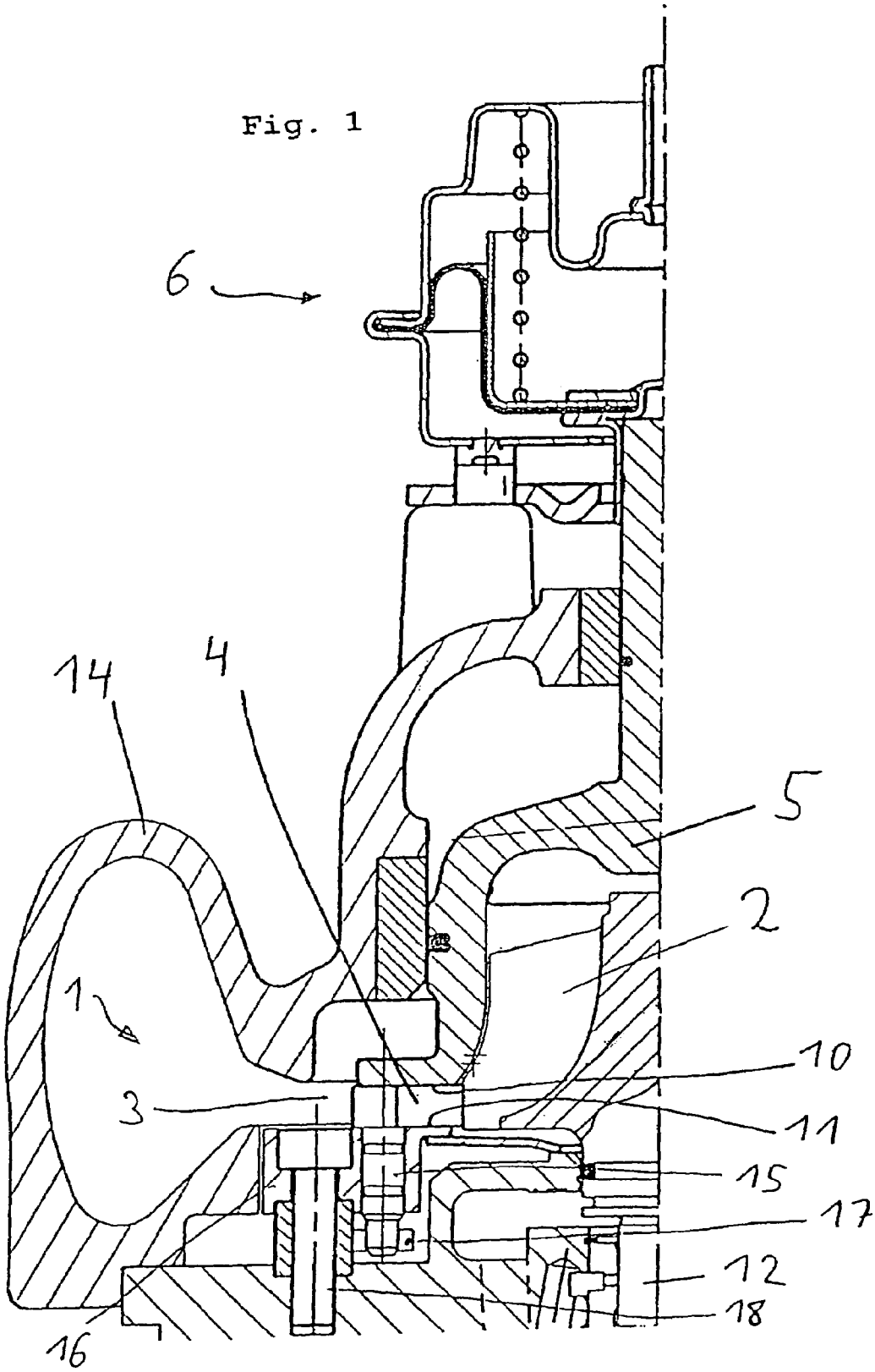
FIG. 1 shows a partial cross-section of a nozzle device for a turbocharger according to a first embodiment of the present invention.

The nozzle device 1 shown in FIG. 1 is to be incorporated in a turbocharger. A conventional turbocharger comprises an exhaust gas driven turbine 2 mounted to a rotatable shaft 12 having a compressor impeller thereon, a turbine housing 19 forming a volute therein for directing an exhaust gas flow from an engine (not shown) to the turbine 2 through an annular nozzle 3. The annular nozzle 3 is defined between an inner and an outer wall 11, 10. Interposed in the nozzle 3, there is an annular arrangement of adjustable vanes 4 for defining a plurality of nozzle passages. The nozzle 3 is adjustable by controllably adjusting the vanes 4 between the inner and outer walls 11, 10 so as to vary the geometry of the nozzle passages.

The vanes 4 are adjusted by means of a vane pivoting mechanism which is described with reference to the figures.

The vane pivoting mechanism consists of a vane pin 15, a vane arm 17, a nozzle ring 16, an unisson ring 14 and an actuating member 18. The vane 4, the vane pin 15 and the vane arm 17 are rigidly connected to each other. The nozzle ring 16 is stationary, while the main arm 18 is pivotable with respect to the unisson ring 14.

Figure 3A:
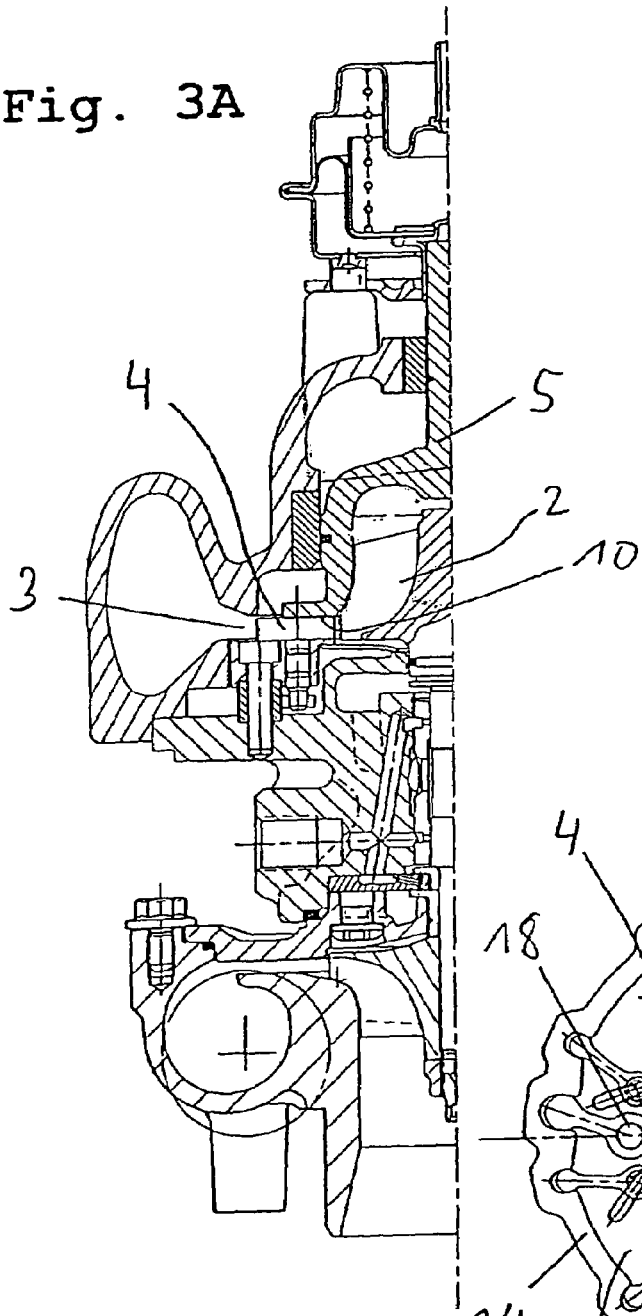
FIGS. 3A and 3B show a cross-sectional view and a plan view of the nozzle device for a turbocharger according to the first embodiment of the present invention, respectively, wherein the nozzle is half open.
Figure 3B:
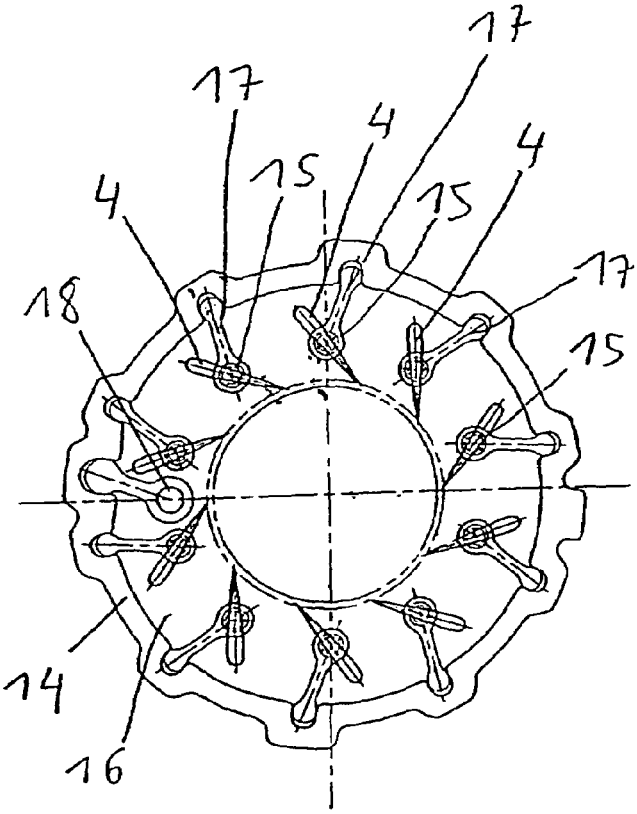

When the main arm 18 rotates the unisson ring 14, as it is shown in FIGS. 3A and 3B, the vanes 4 are pivoted.

In this embodiment, the inner wall 11 of the nozzle ring 16 is formed by an annular ring-shaped plate. Preferably, the annular ring-shaped plate acts like a heat shield. However, the inner wall 11 may also be formed by any part of the turbine housing.

The nozzle device 1 according to the invention comprises a hollow shaft 5 (a hollow piston) surrounding the turbine 2 and defining the outer wall 10 of the annular nozzle 3, the hollow shaft 5 being axially movable to and from the vanes 4.

The hollow shaft 5 is used to cancel the functional gap (right and left side of the vane 4) and increase the turbine stage efficiency all along the engine range until pivoting vane 4 are fully open, then the sliding piston 5 starts to open from the vane top, increasing the passage width and turbine flow capacity, the hollow shaft 5 will be axially moved away from the vanes 4 so as to prevent the vanes 4 from sticking to the outer wall 10 defined by the hollow shaft S.

In this construction, commonly known elements once required in the prior art for adjusting the clearance to approximately zero can be omitted.

The movement of the hollow shaft 5 is effected by an actuator 6 which is, for instance, a pneumatic actuator.

Preferably, the hollow shaft 5 comprises an axial slit (not shown) forming a bypass for exhaust gas which does not pass through the annular nozzle 3.

Preferably, the nozzle device 1 is operated by means for operating the hollow shaft 5 in such a manner that the hollow shaft 5 is moved away from the vanes 4 as an operational rotational speed of the turbocharger increases, and that the hollow shaft 5 is moved to the vanes 4 as the operational rotational speed of the turbocharger decreases.

The operation of the nozzle device 1 will be explained below in more detail with reference to the FIGS. 2A-2B, 3A-3B and 4A-4B.

Figure 2A:
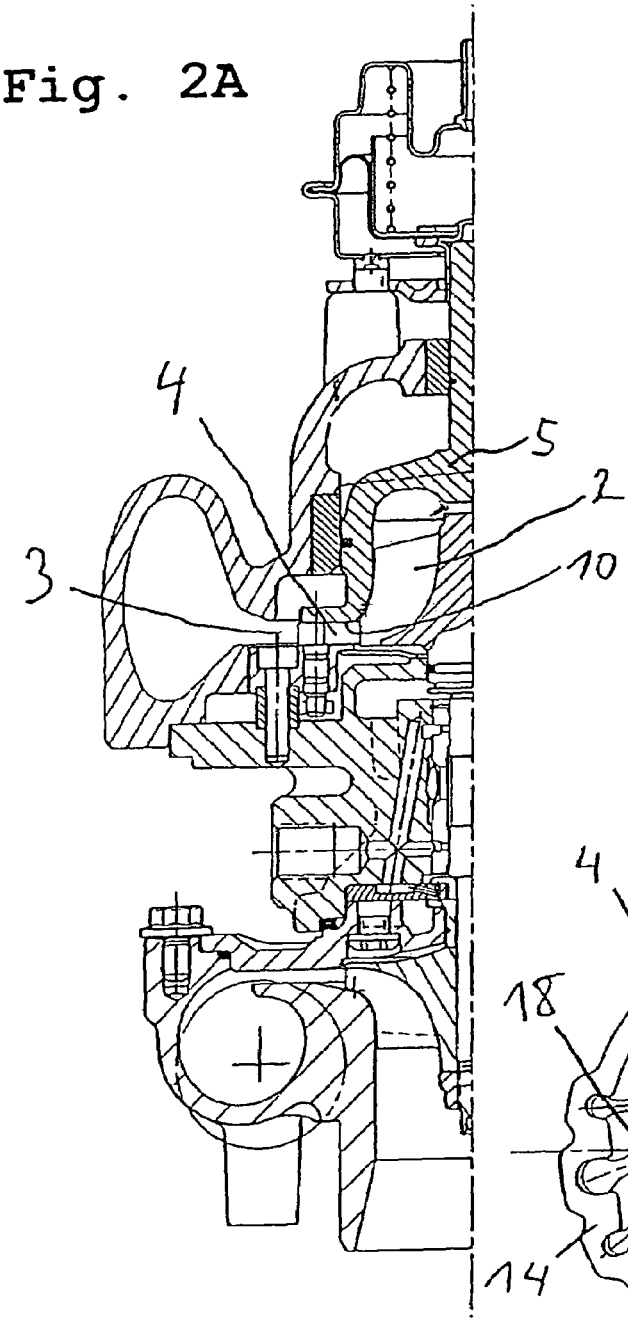
FIGS. 2A and 2B show a cross-sectional view and a plan view of the nozzle device according to the first embodiment of the present invention, respectively, wherein the nozzle is fully closed.
Figure 2B:
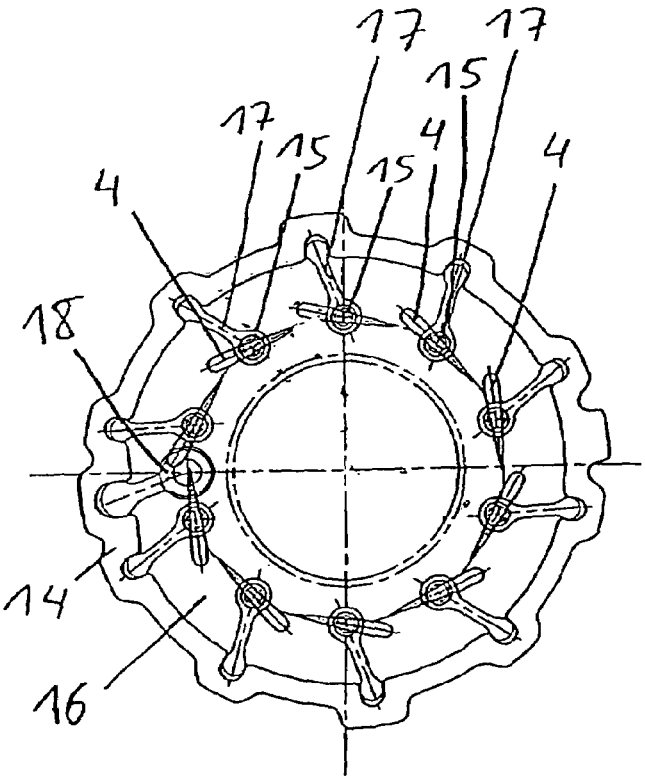

As it is shown in FIGS. 2A and 2B, in a low rotational speed range of the turbocharger, the nozzle passages are closed by the vanes 4. At the same time, the hollow shaft 5 is initially in contact with the vanes 4 so as to cancel the clearance between the vanes 4 and the walls 10. Thereby, the turbine stage exhibits a improved efficiency even in the low rotational speed range of the turbocharger.

As it is shown in FIGS. 3A and 3B, in medium rotational speed ranges, the nozzle passages are opened by the vanes 4 by pivoting the vanes 4, but the hollow shaft 5 is still kept in the position close to the vanes 4. Thereby, the nozzle is half-opened.

Figure 4A:
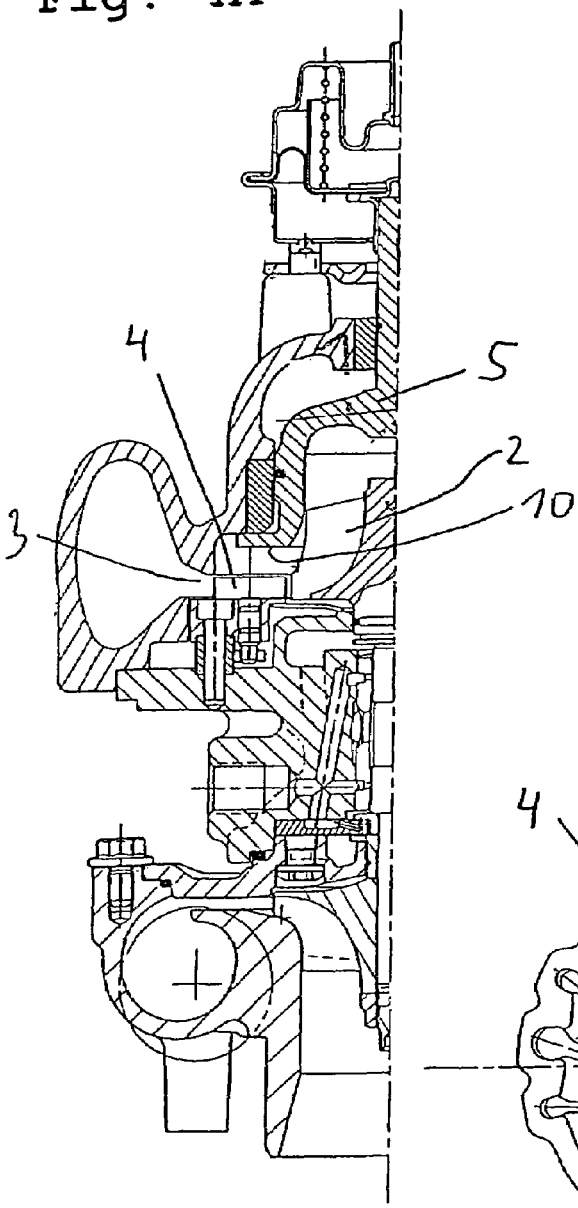
FIGS. 4A and 4B show a cross-sectional view and a plan view of the nozzle device for a turbocharger according to the first embodiment of the present invention, respectively, wherein the nozzle is fully opened.
Figure 4B:
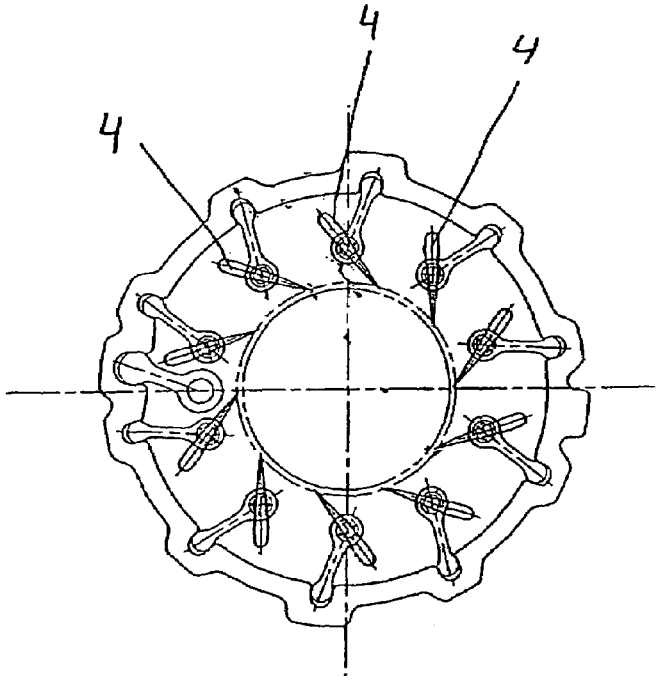

As it is shown in FIGS. 4A and 4B, in high rotational speed ranges, the nozzle passages are further kept open by the vanes 4. At the same time, the hollow shaft 5 is moved away from the vanes 4. Thereby, the vanes 4 are prevented from sticking on the outer wall 10 defined by the hollow shaft 5.

Advantageously, the flow capacity is increased such that an engine backpressure in the high rotational speed range of the turbine 2 is reduced.

If the hollow shaft 5 is additionally provided with the slit for forming the bypass, the flow capacity is further increased such that the engine backpressure in the high rotational speed range of the turbine 2 is further reduced.

The timing of moving the hollow shaft 5 and the timing of pivoting the vanes 4 may be tuned so as to achieve an optimum performance of the turbocharger, i.e. an optimum turbine efficiency, a large boost and a low backpressure. As it is described above, when the rotational speed increases, the vanes 4 are first adjusted to open the nozzle passages. When the rotational speed is further increased, the hollow shaft 5 is then moved away from the vanes 4.

In general, it is possible to start moving the hollow shaft 5 away from the vanes 4 and to start pivoting the vanes 4 for enlarging the gas flow area of the annular nozzle 3 either independently (separately) or simultaneously. It is also possible to start moving the hollow shaft 5 to the vanes 4 and to start pivoting the vanes 4 for reducing the gas flow area of the annular nozzle 3 either independently or simultaneously.

In a similar manner, it is possible to stop moving the hollow shaft 5 away from the vanes 4 and to stop pivoting the vanes 4 for enlarging the gas flow area of the annular nozzle 3 either independently or simultaneously, and/or to stop moving the hollow shaft 5 to the vanes 4 and to stop pivoting the vanes 4 for reducing the gas flow area of the annular nozzle 3 either independently or simultaneously.

The first embodiment can be modified in that, instead of the hollow shaft 5, any means can be provided which comprises a variable outer wall for varying the gas flow to the turbine.

The embodiment according to the present invention achieves a large boost in the low rotational speed range due to the cancelled clearance (also called "zero gap") between the vanes 4 and the outer wall 10 defined by the hollow shaft 5, when the hollow shaft 5 is in a position closest to the vanes 4.

In middle and high rotational speeds of the engine, the backpressure is reduced by moving the hollow shaft 5 away from the vanes 4. The backpressure may be further decreased by the bypass for exhaust gas, which does not pass through the annular nozzle 3.

Figure 5:
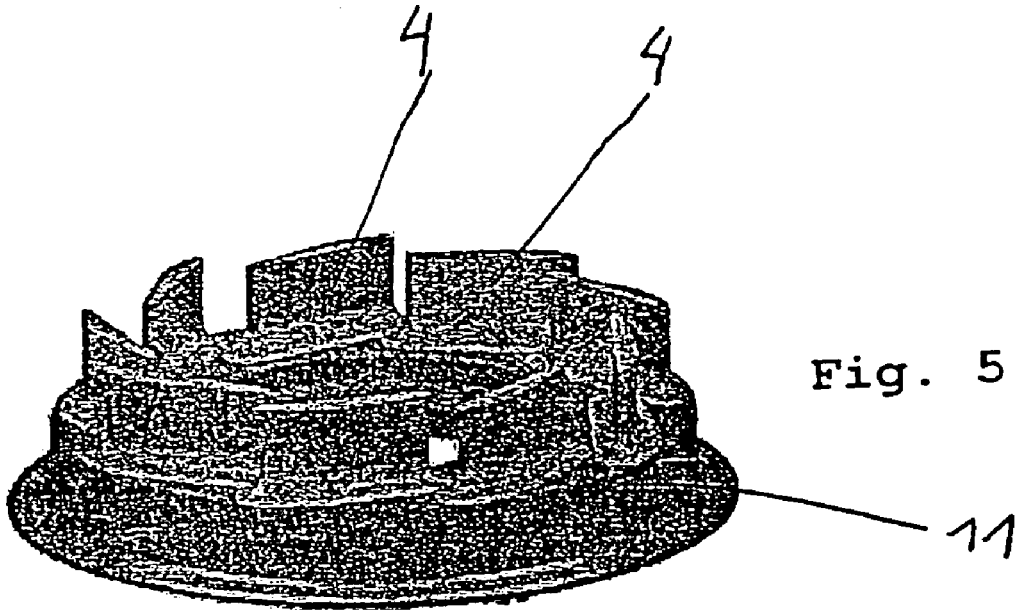
FIG. 5 shows a view of a nozzle device including a vane pivoting mechanism for a turbocharger according to a second embodiment of the present invention.
Figure 6:
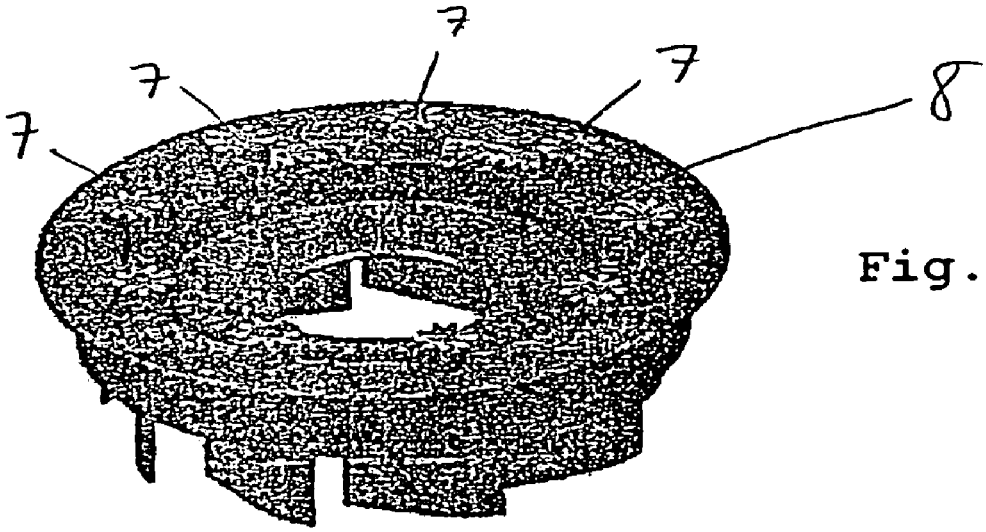
FIG. 6 shows another view of the vane pivoting mechanism depicted in FIG. 5.

A second embodiment according to the present invention shows a nozzle device including a vane pivoting mechanism as it is described with reference to FIGS. 5 and 6.

The vane pivoting mechanism for a variable nozzle device 1 for a turbocharger comprises at least one vane 4 attached to a gear 7 and a gear device 8 being in engagement with the gear 7 so that the vane 4 is pivoted when the gear device 8 is moved relatively to the gear.

Preferably, the vanes 4 are connected via a rod (not shown) with the respective gear wheels 7. The rods pass through the inner wall 11 such that they are rotatably supported by the inner wall 11. For pivoting the vanes 4, there are two alternative modes. In the first mode, the inner wall 11 is rotated while the gear ring 8 is fixed. In the second mode, the gear ring 8 is rotated while the inner wall 11 is fixed.

The provision of the gear wheels 7 and the gear ring 8 for 5 pivoting the vanes 4 is simpler than the prior art arrangement, since many elements can be omitted which were necessary in the prior art, for instance arm vanes, rollers, pins, unisson rings, etc.

Instead of the gear wheel 7, any element having a gear or a toothing can be provided. It is further conceivable that the gears 7 and the ring 8 are in a frictional engagement instead of a meshing engagement.

The embodiments described herein are to be considered as illustrative and they do not limit the scope of protection. The invention can be modified within the scope of the attached claims.

The invention claimed is:

1. A method for operating a variable nozzle device (1) for a turbocharger comprising a plurality of vanes (4) arranged in a nozzle (3) defined between an inner wall (11) and an outer wall (10), the vanes (4) forming nozzle passages, the method comprising the steps of:

adjusting the nozzle passages by controllably adjusting the vanes (4), varying an axial clearance between the outer wall (10) and the vanes (4) by axially moving the outer wall (10) to and from the vanes (4), and increasing the axial clearance between the outer wall (10) and the vanes (4) as the operational rotational speed of the turbocharger increases, and decreasing the axial clearance between the outer wall (10) and the vanes (4) as an operational rotational speed of the turbocharger decreases, wherein the step of increasing the axial clearance between the outer wall (10) and the vanes (4) starts and/or stops either independently from or simultaneously with a step of pivoting the vanes (4) for enlarging the gas flow area of the annular nozzle (3), and/or the step of decreasing the axial clearance between the outer wall (10) and the vanes (4) starts and/or stops either independently from or simultaneously with a step of pivoting the vanes (4) for reducing the gas flow area of the annular nozzle (3).

2. A method for operating a variable nozzle device (1) for a turbocharger according to claim 1, further comprising the step of:

limiting the axial movement of the outer wall (10) to the vanes (4) by a spacer that defines a minimum axial clearance between the vanes (4) and the outer wall (10).

* * * * *